US007704121B2

(12) United States Patent
Goodman

(10) Patent No.: US 7,704,121 B2
(45) Date of Patent: Apr. 27, 2010

(54) LOWER UTERINE SEGMENT MATERNITY SUPPORT BELT

(76) Inventor: Mary Ellen Goodman, 3416 Dorchester Ct., Flower Mound, TX (US) 75022

( * ) Notice: Subject to any disclaimer, the term of this patent is extended or adjusted under 35 U.S.C. 154(b) by 92 days.

(21) Appl. No.: 11/998,477

(22) Filed: Nov. 30, 2007

(65) Prior Publication Data

US 2009/0142988 A1 Jun. 4, 2009

(51) Int. Cl.
*A41C 1/08* (2006.01)

(52) U.S. Cl. ..... 450/155; 128/96.1; 128/99.1; 2/44; 2/45

(58) Field of Classification Search ..... 450/155; 2/44, 45, 92; 128/98.1, 989.1, 100.1, 101, 128/1, 99.1, 96.1
See application file for complete search history.

(56) References Cited

U.S. PATENT DOCUMENTS

| | | | | |
|---|---|---|---|---|
| 1,309,007 | A * | 7/1919 | Allison | 450/155 |
| 5,257,419 | A * | 11/1993 | Alexander | 2/44 |
| 6,921,375 | B2 * | 7/2005 | Kihara | 602/5 |
| 7,022,093 | B2 * | 4/2006 | Smith et al. | 602/2 |
| 7,101,348 | B2 * | 9/2006 | Garth et al. | 602/19 |

* cited by examiner

*Primary Examiner*—Gloria Hale
(74) *Attorney, Agent, or Firm*—Jeffrey Roddy

(57) ABSTRACT

A one piece maternity support for the relief of discomfort associated with the progressive changes in the human body associated with a normal pregnancy. The support has a body encircling upper band for the support of the lower uterine segment and a lower belt having a pair of tensionable arms that connect to the upper band to support the lumbar region and offer counter rotational force for the anteriorly tilted pelvis. The position of the lower arms is optimized to apply a constant pressure to the muscles above the hip joint providing relief from so-called hip pain associated with many pregnancies.

7 Claims, 4 Drawing Sheets

LOWER UTERINE SEGMENT MATERNITY SUPPORT BELT

CROSS REFERENCE TO RELATED APPLICATIONS

None

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC

Not applicable

BACKGROUND OF THE INVENTION

The present invention relates generally to devices providing abdominal support and lower back support for the relief of discomfort associated with normal pregnancy.

It is well known that the body changes associated with pregnancy give rise to conditions that can cause a woman significant discomfort or pain ranging from mild to severe. Among the body changes are:

Normal weight gain and the added weight of the developing fetus shift the iliac crest of the pelvis forward in what is called anterior pelvic tilt which in turn causes the lumbar region of the spine to assume an exaggerated s-curve. Attempts to correct ones posture lead to even more curvature and increased stress placed on the lumbar region especially from L3-L5. A sense of increased pressure in the abdominal region and lower back pain are common complaints. In addition to the aforementioned changes, the pelvic ligaments relax due to the production of relaxin which causes the cartilage of joints to become increasingly malleable which allows the bones to shift and displace causing pain. While often referred to generically as "hip pain", it encompasses a variety of conditions such as pelvic arthropathy.

Devices in the past that meant to address the related problems of lumbar support and abdominal support have fallen into several basic categories:

multi-piece units with wide abdominal bands and ribbed lumbar support, units integrated with and into an undergarment, those releasably detachable from an undergarment and single piece units worn over an undergarment or next to the skin.

User preference plays a significant role in the selection of a supportive device, each type having its relative advantages and limitations such as better lumbar or abdominal support respectively.

Previous devices that are one piece and worn over an undergarment or next to the skin appear to be the most closely related to the present invention. One of the significant limitations of the such devices is the absence of a means to relieve so-called hip pain and it is this limitation among others that the present invention addresses while improving the support means for the lower uterine segment and the lumbar region of the spine.

BRIEF SUMMARY OF THE INVENTION

The present invention is a one piece lower uterine segment support belt that addresses the aforementioned limitations of similar type belts by providing an upper wraparound belt with free ends positioned just under the iliac crest on either side of the pelvis and fastened in front over the uterine segment providing lower abdominal support and a lower belt having two free ends shorter than that of the upper belt that are releasably attachable to the upper belt at various distances forward of the left and right iliac crests. This configuration provides a tensionable connection between the lower lumbar region (L3-L5) and the top of the sacral curve in the anteriorly tilted pelvis and that area ahead of the iliac crest, thus applying counter rotational force to the anteriorly tilted pelvis. In addition to pelvic stabilization, the position of the tensioned lower belt over the iliotibial band and the tensor fasciae latae, compresses the tissue over the hip joints offering significant relief from so-called hip pain. Indeed, a common acupressure therapy for the temporary relief of such hip pain is to have the woman lie on her side while having the therapist apply downward pressure over the hip joint, and it is believed that the present invention mimics this action while it is worn.

In addition to the aforementioned advantages, the present invention provides a pocket positioned over the lumbar region that may optionally accommodate a hot or cold pack. This is especially useful as hot and cold therapy helps to mitigate pain and cold therapy alone can numb the area. A variety of hot and cold packs of differing construction exist on the market. The integrated pocket of the present invention could accommodate a pack of up to six inches in width and up to eighteen inches in length. The support may also be reversed post partum by placing the pocket over the lower abdomen and connecting the longer strap behind the back at the waist and the shorter arms in back behind the hips.

One object of the present invention is to provide a lightweight non-restrictive abdominal support especially for the support of the lower uterine segment and lumbar region for the relief of abdominal pain, and lower back pain associated with pregnancy.

Another object of the present invention is to provide a means for applying constant but adjustable pressure over the hip joint for the relief of pain conditions associated with the relaxation of pelvic ligaments.

Another object of the present invention is to provide a counter rotational force directed to the anteriorly tilted pelvis thus assisting the person in maintaining a more neutral posture.

A further object of the present invention is type provide relief from round ligament pain by assisting with pelvic stabilization, thus helping a person maintain better posture.

Yet another object of the present invention is to provide a means for the application of hot and cold therapy to the lumbar region.

The applicant is not aware of any previously described art having the features and advantages of the present invention.

Other objects and advantages of the present invention will become apparent from the following descriptions, taken in connection with the accompanying drawings, wherein by way of illustration and example, a preferred embodiment of the present invention is disclosed.

DETAILED DESCRIPTION OF THE INVENTION

Figure 1:
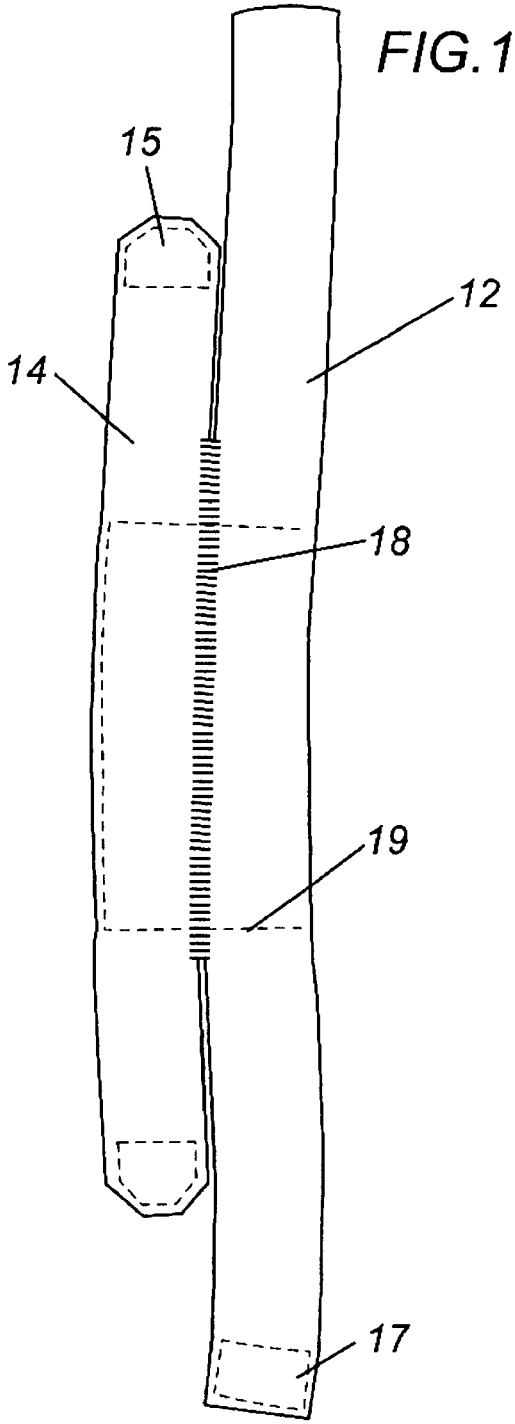
FIG. 1 is a plan view of the outwardly facing side of the present invention.

FIG. 1 is a plan view of the outwardly facing side of the present invention showing an upper belt 12, and a shorter belt 14, both of elastically deformable material, each of which has two free ends and each of about 3 inches in width and together aligned at their respective midlines and partway conjoined by stitching 18 effectively creating a solid elastic panel that extends around the base of the wearers back and specifically over the lumbar region. In applying the belt the two ends of the upper belt are brought together to form an encircling band about the body and each of the two free ends of the shorter belt 14 are attached to the upper band to any point ahead of the right and left side iliac crest. The lower belt ends are separately tensionable and apply a counter rotational force for the anteriorly tilted pelvis to assist in maintaining better posture. The upper belt is variably tensionable allowing one to tighten or loosen the abdominal support as the pregnancy progresses.

Figure 2:
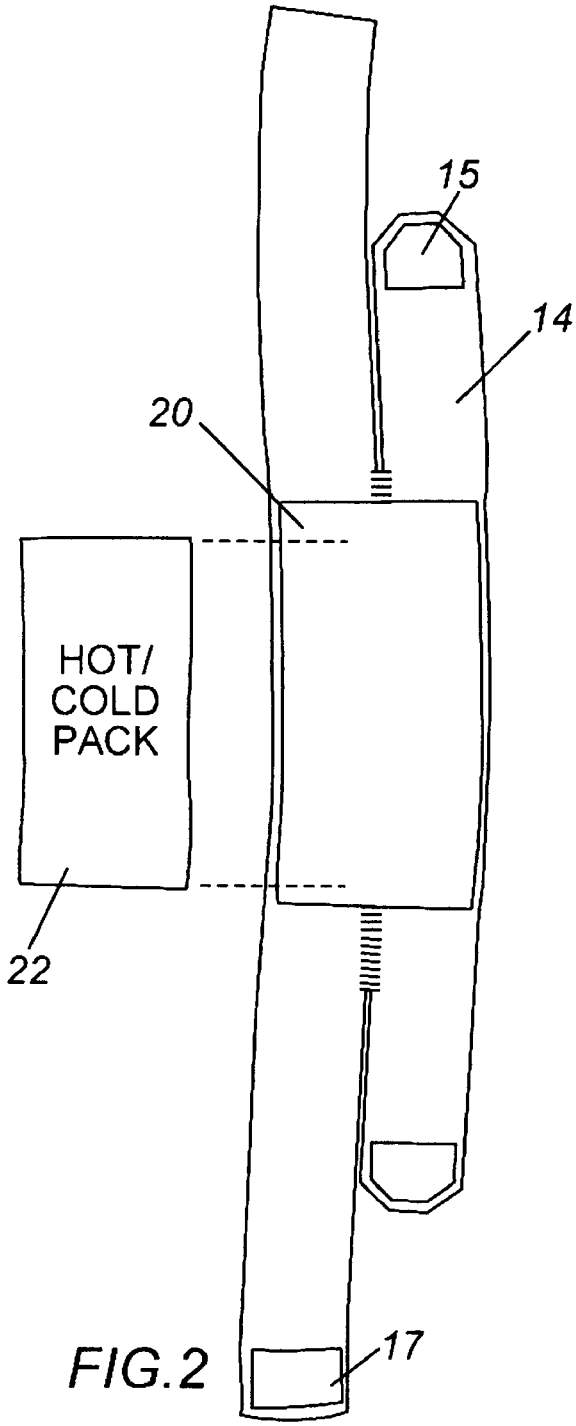
FIG. 2 is an plan view of the body facing side of the present invention showing integrated pocket.

FIG. 2 is a plan view of the inwardly facing side of the present invention showing a pocket 20 made to accommodate a hot and cold pack and the hook type fastener patches 17,15 on the upper and lower belts.

Figure 3:
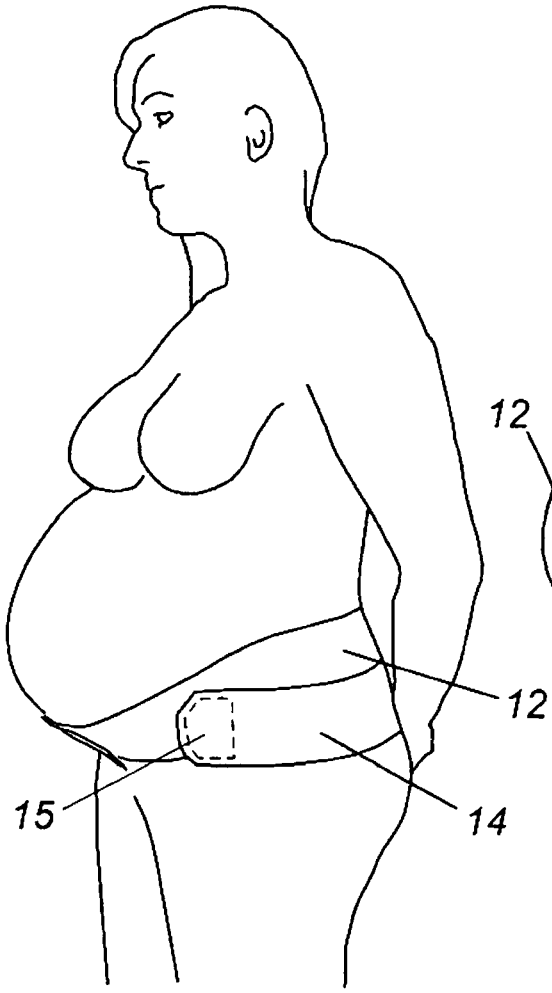
FIG. 3 is a perspective view of the present invention in typical use being worn about the hips.

FIG. 3 is a perspective view of the present invention in typical use being worn about the hips showing the upper belt 12 encircling the body and running just under the right and left side iliac crests respectively. The free ends of the lower belt 14 are attached to the upper belt ahead of the iliac crest. The low slung fit of the lower belt enables it to apply compression to the sides at the hip over the iliotibial band and the tensor fasciae latae thus offering relief from so-called hip pain associated with the loosening of the pelvic ligaments.

Figure 4:
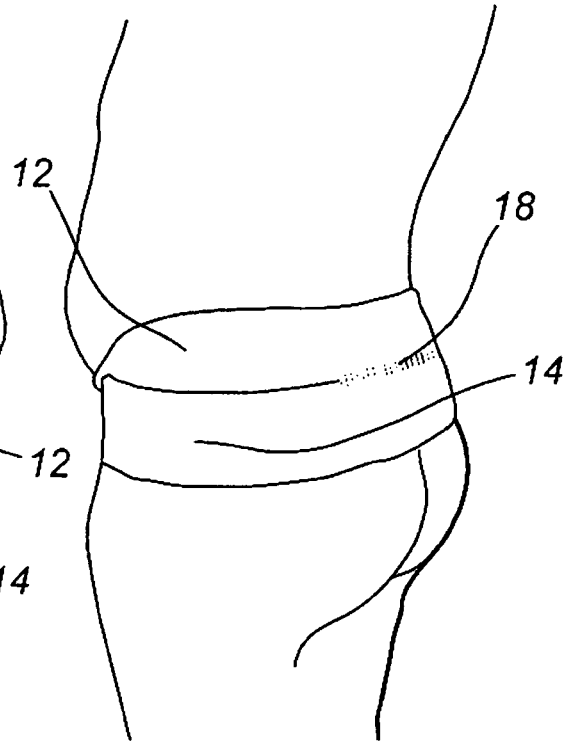
FIG. 4 is a perspective view of the present invention in typical use being worn showing the device as it encircles the back.

FIG. 4 is a perspective view of the present invention showing the conjoined belts stitched together 18 forming a solid elastic band over the lumbar region.

Figure 5:
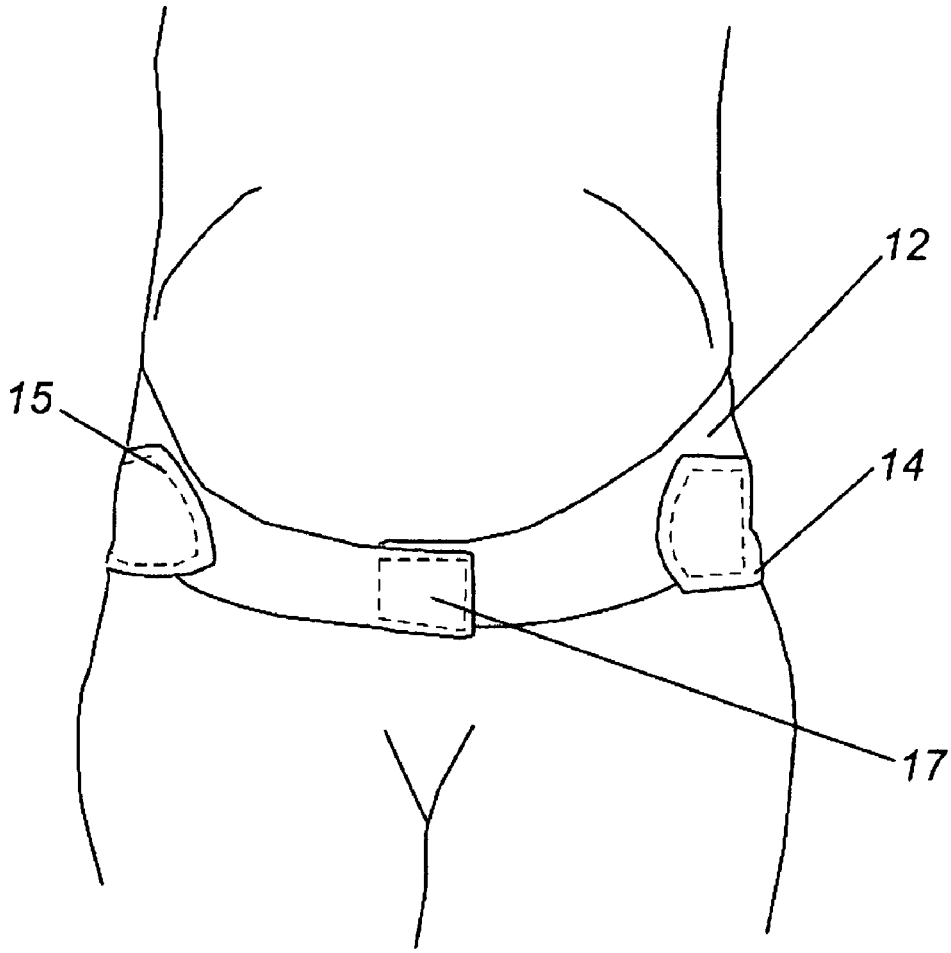
FIG. 5 is perspective view of the present invention in typical use being worn showing the arrangement of the upper and lower belting at the front of the body.

FIG. 5 is a perspective view of the present invention showing the upper belts ends fastened together forming an encircling band 12 about the body, and the positioning of the left and right free ends 14 of the lower belt attached to the upper belt ahead of the iliac crest. The inwardly facing hook fastener portions 15,17 are shown by hidden lines; they attach to the outwardly facing belt which has a pile exterior and operate in the same fashion as a hook and loop fastener.

Figure 6:
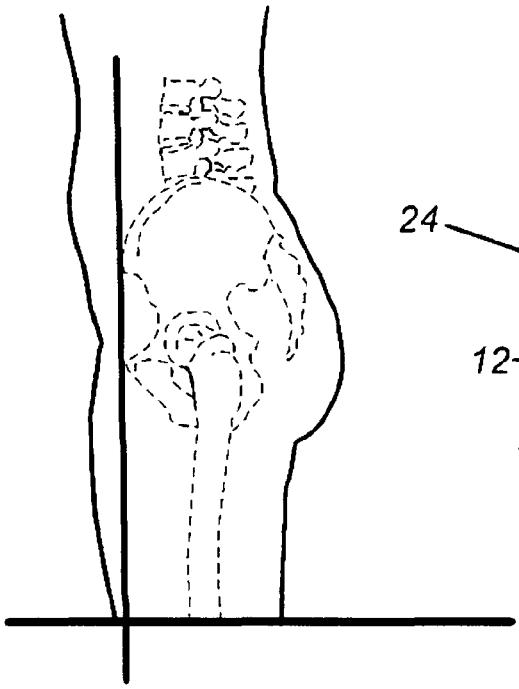
FIG. 6 is a side anatomical view of the pelvis in neutral position.
Figure 7:
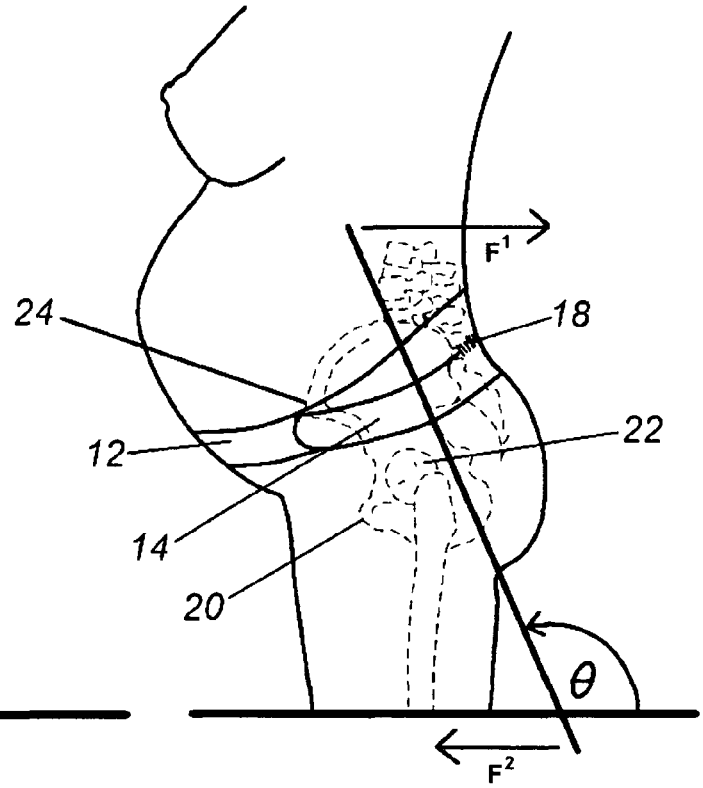
FIG. 7 is a side anatomical view of an anteriorly tilted pelvis and the positioning of the present invention about the body.

For illustrative purposes, FIG. 6 is a side anatomical view of the pelvis in neutral position (non pregnancy), whereas FIG. 7 shows the anteriorly tilted pelvis of pregnancy. Unlike the line drawn between the symphysis pubis and the iliac crest in FIG. 6, the same line of pelvic deflection is severely angled in FIG. 7. This tilting of the pelvis is a normal consequence of pregnancy, but results in an exaggerated s-curvature of the lumbar region of the spine and accompanying lower back pain. Relaxation of the pelvic ligaments and a loosening of the pelvic joints also results in hip pain that may be mitigated to some degree by applying pressure to the muscles overlying the hip joint. The anteriorly tilted pelvis may be thought of as a see-saw with the fulcrum being the top of the sacrum. The present invention is able to better leverage the pelvis by fitting to the lower lumbar region and extending over the top of the sacral curve where the lines of applied force are $F^1$ and $F^2$; this positioning accounts for the improved leverage obtained in using the present invention in stabilization of the pelvis and the low slung fit allows the free ends of the lower belt 14 to apply pressure over the muscles above the hip joint to relieve pain associated with pelvic arthropathy and other related conditions resulting from the loosening of the pelvic ligaments. The belt is applied to the body by first fastening the free ends of the upper belt whereby the belt will stay in position, and then by pulling the two free ends of the lower belt and bringing then up and forward to attach to the upper belt ahead of the iliac crest. As the upper belt has a pile covering the exterior, the hook fastener portions 15 of the lower belt may be tensionably adjusted to any point ahead of the iliac crest for the desired level of comfort and support.

I claim:

1. A one piece maternity support for abdominal and lumbar support comprising:

a tensionable upper belt and a tensionable lower belt each of elastically deformable material; and, each of said belts adjacently aligned along their transverse midpoints, and abutting each other and partway conjoined where abutting, each of said belts having two free ends; and, said free ends of upper belt releasably attachable to each other forming a body encircling elastic, band supportive of the wearer's lower uterine segment; and, each of said free ends of lower belt releasably attachable to said upper belt forward of the wearer's iliac crest on the left and right side of the body respectively, and providing counter rotational force for the wearer's anteriorly tilted pelvis and constant adjustable pressure over the wearer's ileotibial band and the tensor fasciae latae.

2. The maternity support of claim 1 wherein said lower belt is between 65 and 75 percent of the length of the said upper belt.

3. The maternity support of claim 1 wherein said attachment is by means of a hook and pile type.

4. The maternity support of claim 1 having an inwardly facing pocket for the optional releasable retention of a hot and cold pack providing thermo therapy to the lumbar region in normal position, and by rotating the positioning of said support by 180 degrees, the abdominal region.

5. A one piece maternity support for a wearer's abdominal and lumbar region comprising:

a tensionable upper belt and a tensionable lower belt each of elastically deformable material; and, the maternity support in which the upper belt and the lower belt are aligned parallelly at their respective transverse midpoints, and side by side, and abutting one another, and conjoined partway along the respective lengths of the upper and lower belts; and, the free ends of the upper belt releasably attachable together to form an encircling elastic band supportive of the wearer's lower uterine segment; and, each of the free ends of the lower belt releasably attaching to said upper belt forward of the wearer's iliac crest on the left and right side of the body respectively; and, the lower belt providing counter rotational force for the wearer's anteriorly tilted pelvis and constant adjustable pressure over the wearer's ileotibial band and the tensor fasciae latae.

6. The maternity support of claim 5 wherein said lower belt is between 65 and 75 percent of the length of the said upper belt.

7. The maternity support of claim 5 having an inwardly facing pocket for the optional releasable retention of a hot and cold pack providing thermo therapy to the lumbar region in normal position, and by rotating the positioning of said support by 180 degrees, the abdominal region.

* * * * *